US005658177A

United States Patent [19]

Wagner

[11] Patent Number: 5,658,177

[45] Date of Patent: Aug. 19, 1997

[54] MOUNTING ARRANGEMENT FOR ENGINE STEERING CYLINDER

[75] Inventor: Jerald G. Wagner, Venice, Fla.

[73] Assignee: IMO Industries, Inc., Sarasota, Fla.

[21] Appl. No.: 522,507

[22] Filed: Sep. 1, 1995

[51] Int. Cl.[6] ..... B63H 20/12

[52] U.S. Cl. ..... 440/61; 114/150

[58] Field of Search ..... 114/144 R, 150; 440/1, 2, 53, 61, 62, 63; 248/640–642

[56] References Cited

U.S. PATENT DOCUMENTS

| | | | |
|---|---|---|---|
| 2,787,235 | 4/1957 | Schroeder | 114/150 |
| 2,855,755 | 10/1958 | Auger | 60/54.5 |
| 4,482,330 | 11/1984 | Cook | 440/2 |
| 4,687,448 | 8/1987 | Peirce | 440/61 |
| 4,773,882 | 9/1988 | Rump | 440/61 |
| 4,836,812 | 6/1989 | Griffiths | 440/61 |
| 5,149,285 | 9/1992 | Kinoshita | 440/61 |
| 5,328,394 | 7/1994 | Onoue et al. | 440/61 |
| 5,340,341 | 8/1994 | Yoshimura | 440/61 |
| 5,542,864 | 8/1996 | Peebles | 440/61 |

*Primary Examiner*—Stephen Avila
*Attorney, Agent, or Firm*—Jansson & Shupe, Ltd.

[57] ABSTRACT

The new "universal" mounting bracket is used to couple a hydraulic steering cylinder to one of first and second brands of outboard engines. Such bracket has first and second groups of holes, the holes comprising each group positionally corresponding to a bracket attachment hole in the first or second brand of engine. The cylinder has first and second spaced mounting faces that are angled with respect to a cylinder axis. The bracket has first and second end members contacting the first and second faces, respectively. A mounting face and its respective end member are in compression when resisting steering force.

The bracket optionally includes at least one cutout area (and preferably two or more cutout areas) for fitting the bracket around a Zerk fitting on a particular brand or brands of engine.

22 Claims, 7 Drawing Sheets

MERCURY
PRE-1989

OMC

V-SUZUKI

YAMAHA

MERCURY

OMC
COMMERCIAL

SUZUKI
1-4

MOUNTING ARRANGEMENT FOR ENGINE STEERING CYLINDER

FIELD OF THE INVENTION

This invention relates generally to ships and boats, and, more particularly, to vessel steering.

BACKGROUND OF THE INVENTION

Water-going vessels are steered in any of a variety of ways. One way—commonly used on seagoing vessels and on larger pleasure craft—is by a separate rudder steering a vessel powered by one, two or more "screws" (propellers). The orientation(s) of the propeller(s) remain unchanged with respect to the vessel hull.

Another way commonly used with smaller pleasure craft is to pivot all or a part of the propulsion system so that the rotational axis of the propeller moves with respect to the vessel hull and its long axis. On so-called inboard-outboard drives, only a portion of the propeller drive train pivots. However, on boats driven by outboard engines, the entire engine (but for its stern mounting bracket and the like) are pivoted on the transom of the boat.

Smaller outboard engines are steered by an operator sitting at the rearmost seat and grasping the engine handle. Such handle not only pivots the engine about a generally vertical axis, it usually includes a twist-type throttle control. Thus, the operator controls vessel speed and direction with one hand.

But for larger outboard engines, hand steering in that manner is impractical. For one thing, the engine is simply too heavy to steer with one hand. And boats large enough to accept such an engine usually have steering and throttle controls at a forward seat location. The operator faces directly forward as when driving an automobile.

Larger outboard engines are often steered using some type of "force-multiplying" mechanism such as a steering wheel and control cable, the latter as made by Morse Controls and others. Or steering may be by hydraulic cylinder systems as made by Hynautic, Sarasota, Fla. In a common arrangement, the cylinder body is mounted in a fixed location and a cylinder rod is coupled to the engine tiller bar by a steering link. In another arrangement, the rods are at a fixed location and the cylinder body is coupled to the tiller bar for bar movement.

Apparatus for boat steering are shown in U.S. Pat. Nos. 2,787,235 (Schroeder); U.S. Pat. No. 4,773,882 (Rump); U.S. Pat. No. 4,836,812 (Griffiths); U.S. Pat. No. 5,340,341 (Yoshimura) and, no doubt, others. A problem faced by outboard engine builders and designers of cylinder-equipped hydraulic steering systems is the matter of mounting the cylinder with respect to the engine. The problem is very evident from an analysis of the noted patents.

In the arrangement disclosed in the Griffiths patent, the center bracket on which the steering cylinder is rigidly mounted is, itself, rigidly attached to the steering arm of the primary engine. The arrangement assumes that such steering arm includes mounting holes or, dismayingly, the boat builder or user must provide such holes.

The steering assembly shown in the Rump patent uses a cylinder with a projecting tongue that pivotably pins to the engine tiller arm. Like that of the Griffiths patent, the Rump arrangement seemingly assumes that the tiller arm comes equipped with a mounting hole.

The arrangements shown in U.S. Pat. No. 2,855,755 (Auger) and in the Schroeder and Yoshimura patents "side-step" the matter of closely-coupling the cylinder and the engine to one another. Instead, the cylinder is mounted some distance from the engine and long linkages are used to connect the two together. In that way, the cylinder designer can ignore the differing mounting provisions configured by the engine manufacturers.

But these arrangements tend to be (in the vernacular) "Rube-Goldberg-like." Manufacturing boat and engine builders are not likely to be enthusiastic about them, at least because they are aesthetically lacking. And some arrangements are seemingly very time-consuming to mount. (Of course, extended assembly time translates into extended manufactured cost, selling price and, later, difficulty in repair.)

Known prior art mounting arrangements which space the steering cylinder well away from the engine being steered simplify the task of the designer of such mounting arrangements in another way. One need not fit a mounting bracket to avoid such seemingly-innocuous but critical appurtenances as "Zerk" grease fittings for lubricating the tilt tube. (Zerk type grease fittings are well known, are installed on, inter alia, passenger autos and are configured for use with a pressurized grease gun.)

Another disadvantage of prior art arrangements like those of the Schroeder, Auger and Griffiths patents involves the bolting arrangement. The forces imposed on the bolts are shear forces and it is only (or substantially only) shear forces that secure the mounting bracket and the cylinder with respect to one another. To put it in other words, these prior art arrangements do not appreciate how to configure a mounting bracket to substantially avoid imposing shear forces upon the securing bolts.

Yet another disadvantage of prior art arrangements is that they are not invertible in use. In other words, they can be used in but a single orientation. Such arrangements fail to appreciate how a mounting bracket can be configured to be invertible so as to adapt to a variety of brands of engines.

The fact that prior workers in the field have sidestepped the problem of trying to directly mount a hydraulic steering cylinder to any of a variety of outboard engines is not surprising—the problem has persisted for some years and is not easy to solve. "Single-use" mounting brackets make the work of the boat builder (or of the company mounting an engine to a boat) more difficult. This is so because such builder or company must stock a variety of mounting brackets, at least one for each brand of outboard engine anticipated to be equipped with a steering cylinder.

The invention offers a bold and imaginative solution to the matter of cylinder/engine mounting. Details regarding such invention are set forth below.

OBJECTS OF THE INVENTION

It is an object of the invention to provide a steering cylinder mounting arrangement overcoming some of the problems and shortcomings of the prior art.

Another object of the invention is to provide a steering cylinder mounting arrangement which is aesthetically attractive.

Another object of the invention is to provide a steering cylinder mounting arrangement which is compact and space-saving.

Yet another object of the invention is to provide a steering cylinder mounting arrangement that accommodates different outboard engines.

Another object of the invention is to provide a steering cylinder mounting arrangement that substantially avoids imposing shear forces upon the mounting bolts.

Still another object of the invention is to provide a steering cylinder mounting arrangement which reduces mounting-hardware-related inventory.

Another object of the invention is to provide a steering cylinder mounting arrangement which accommodates outboard engine grease fittings.

Another object of the invention is to provide a steering cylinder mounting arrangement in which the mounting bracket is invertible to facilitate adapting the arrangement to a variety of outboard engines. How these and other objects are accomplished will become apparent from the following descriptions and from the drawings.

SUMMARY OF THE INVENTION

The invention involves a mounting bracket for coupling a hydraulic steering cylinder to either one of first and second "brands" (e.g., Outboard Marine Corporation (OMC), Mercury, Suzuki) of outboard engines. The bracket has first and second groups of holes, each hole of each group positionally corresponding to a bracket attachment hole in a particular brand of engine. (Stated another way, each group of bracket holes has plural holes corresponding in location and number to the cylinder mounting holes of a particular brand of engine.)

In a highly-preferred embodiment, the bracket also has a third group of holes, each of which positionally corresponds to a bracket attachment hole in a third brand of engine. Each group of holes may includes two, three, four or even more holes. However, in preferred embodiments, there are four holes in each group.

The new bracket also has features permitting such bracket to be used in either of two orientations, each inverted from the other. Such bracket is thereby adapted to fit a wider variety of engine brands and/or to accommodate certain engine features. The bracket has first and second edges, the first edge being upward when the bracket is positioned for attachment to the first brand of engine. When the bracket is positioned for attachment to the second brand of engine, the second edge is upward. In a specific embodiment, both edges are parallel and generally horizontal in either orientation.

A preferred mounting location for the new bracket is closely adjacent to the tilt tube of an outboard engine, i.e., that elongate, generally-cylindrical tube about which the engine pivots or tilts. It is desirable to periodically lubricate the tube for easy tilting and manufacturers install one or more grease fittings for that purpose.

Another feature of the new bracket involves at least one bracket cutout area along one edge, e.g., the second edge so that the bracket can be fitted around a Zerk fitting on a particular engine brand. In a highly-preferred embodiment, the bracket has two or three cutout areas along such second edge for adapting the bracket to at least two brands of engines.

The new bracket is used in combination with a steering cylinder mounted to the engine by such bracket. The cylinder extends along an axis and has a steering rod exerting a steering force that pivots the engine for steering.

The cylinder has first and second spaced mounting faces which are angled with respect to the axis (preferably at 90° to the axis) and the bracket includes conformably-spaced first and second end members contacting the first and second faces, respectively. The first and second mounting faces and, respectively, the first and second end members are alternately in compression when resisting steering force. (That is to say, when steering left, the first end member and first face are in compression and when steering right, the second end member and second face are in compression.)

Such configuration substantially prevents shear forces from being applied to the cylinder/bracket holding bolts. In other words, such bolts are used substantially only in tension as bolts are intended to be used.)

And that is not all. There are other aspects of the invention that enhance the rigidity with which the cylinder and the bracket are secured to one another. The steering cylinder includes first and end portions, each having one or plural surfaces. The bracket end members each include an edge contacting the respective surface or plural surfaces. The mounting bracket thereby resists cylinder twisting about an axis coincident with or parallel to the cylinder axis. (For reasons that will become apparent from the detailed description, cylinder end portions with plural flat surfaces are preferred.)

In another aspect of the invention, a steering linkage extends between the engine tiller and aperture at the end of the rod. Such linkage includes first and second link members, e.g., a clevis and a draglink, threaded to one another. The first link member has plural pin openings while the second link member has but a single pin opening, all openings being generally normal to the long axis of the linkage.

A pin extends laterally between the pin opening in the second link member and one of the pin openings in the first link member. Such threaded attachment permits adjusting the aggregate length of the linkage by adjusting the position of the first link member on the second link member. And the pin prevents such adjusted position from changing by preventing rotation of the first link member with respect to the second link member.

The first link member includes a flat, tongue-like attachment portion for coupling the first link member to the tiller. Such attachment portion is held in alignment with the tiller by the pin.

Other details of the invention are set forth in the following detailed description and in the drawings.

DETAILED DESCRIPTIONS OF PREFERRED EMBODIMENTS

Figure 1:
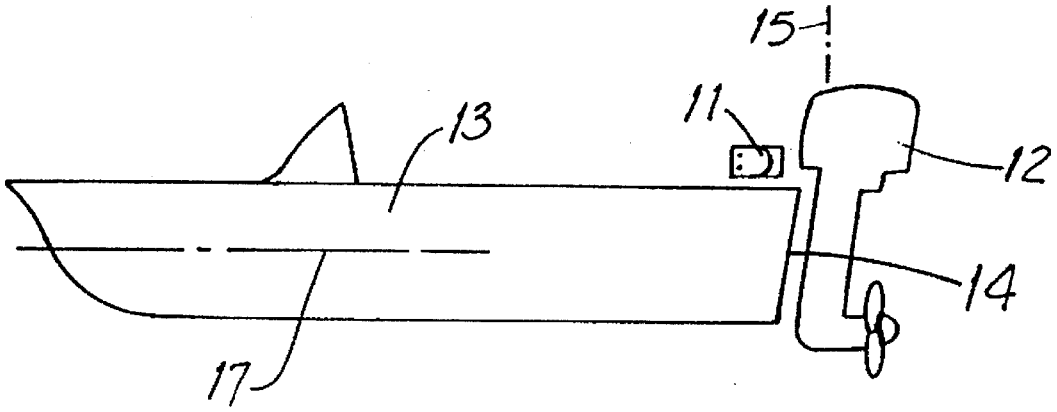
FIG. 1 is a representative view of a boat equipped with an outboard engine and a steering cylinder secured to the engine by the new mounting bracket.

Before describing details of the new bracket 10 and how it is used to mount a cylinder 11, it will be helpful to have a general understanding of how the cylinder 11 is mounted on and used to steer an outboard engine. Referring first to FIG. 1, an outboard engine 12 is mounted to the stern transom 14 of a boat 13. The steering cylinder 11 is mounted to the engine 12 in any of the several ways described below. When the cylinder 11 is actuated, the engine 12 pivots about a generally-vertical steering axis 15 which is about normal to the boat long axis 17.

Figure 2:
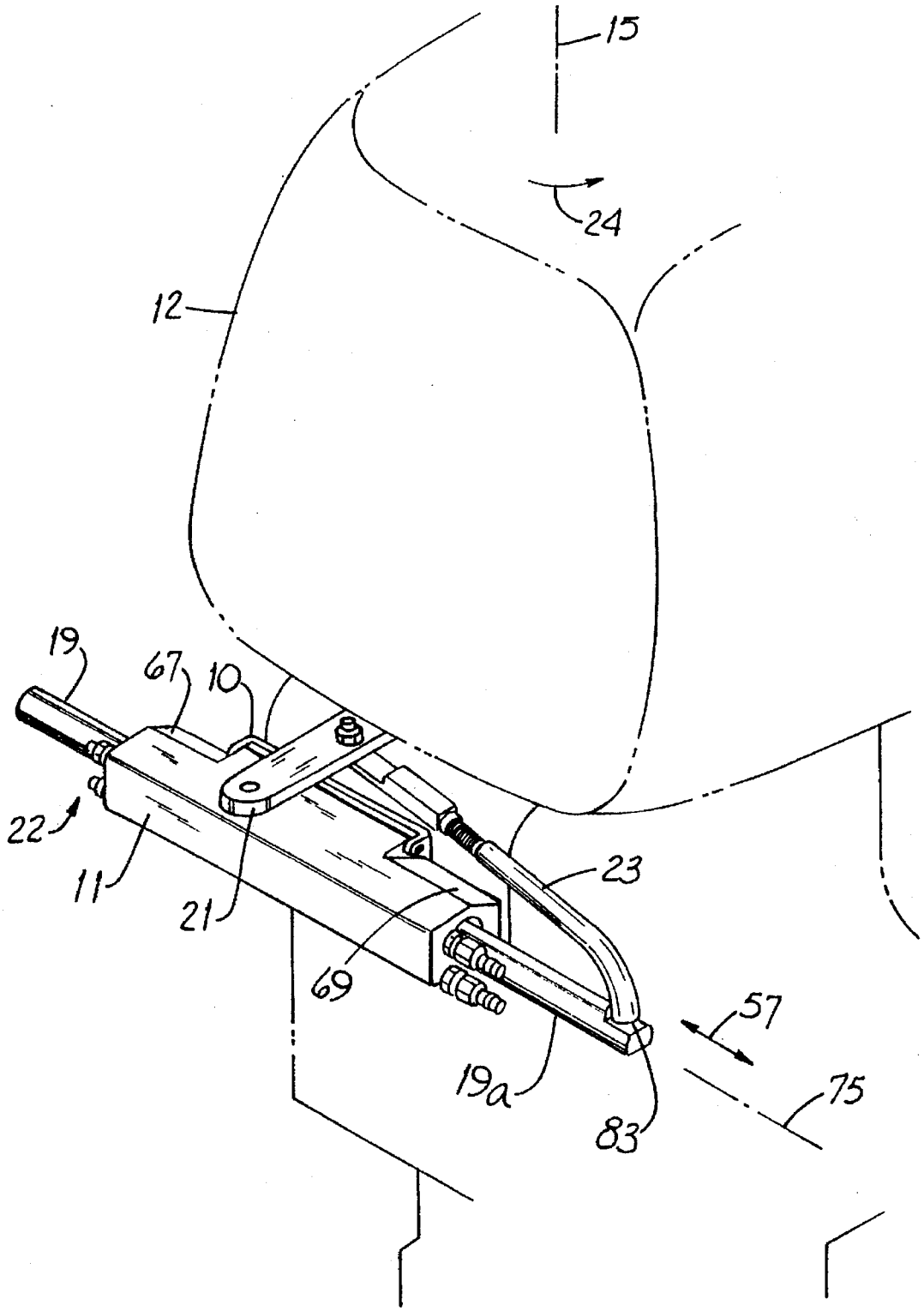
FIG. 2 is a close-up perspective view of the improved outboard engine steering cylinder shown in conjunction with an outboard engine represented in dashed outline.

Referring also to FIG. 2, the steering cylinder 11 is of the "double-ended" type, so named because a rod 19, **19*a* extends from respective cylinder ends. The rod 19*a* is coupled to the engine tiller bar 21 by a linkage 23 and is capable of being extended or retracted by the introduction of hydraulic fluid into one of the two fittings 22. When the rod 19*a* is extended, the engine 12 pivots counterclockwise (as viewed "top down" and as symbolized by the arrow 24) and the boat 13** steers to the right.

Figure 3:
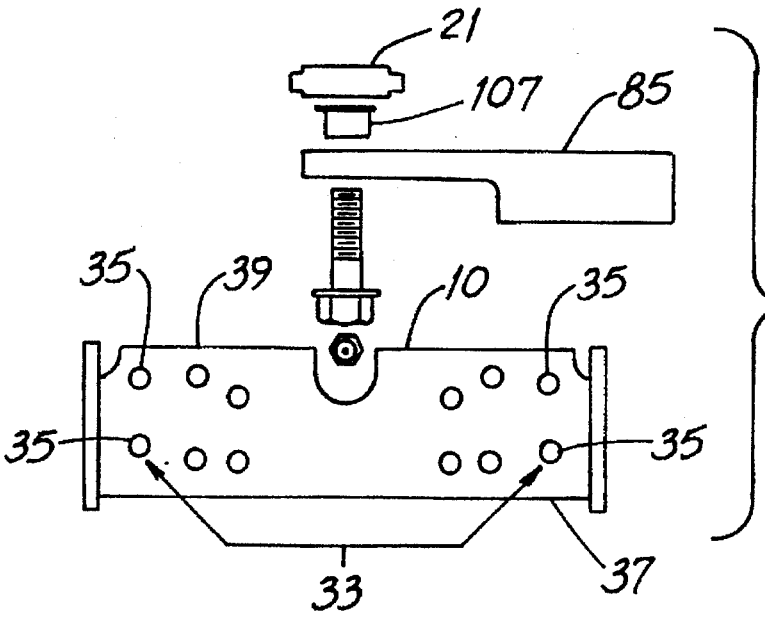
FIG. 3 is an elevation view of the new mounting bracket arranged for attachment to a pre-1989 Mercury engine.
Figure 4:
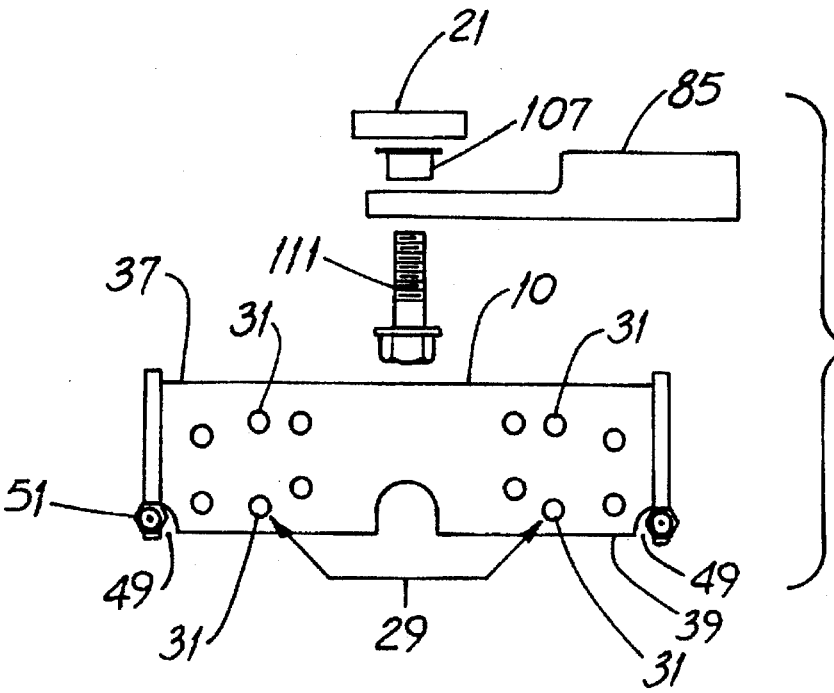
FIG. 4 is an elevation view of the new mounting bracket arranged for attachment to an OMC engine.
Figure 5:
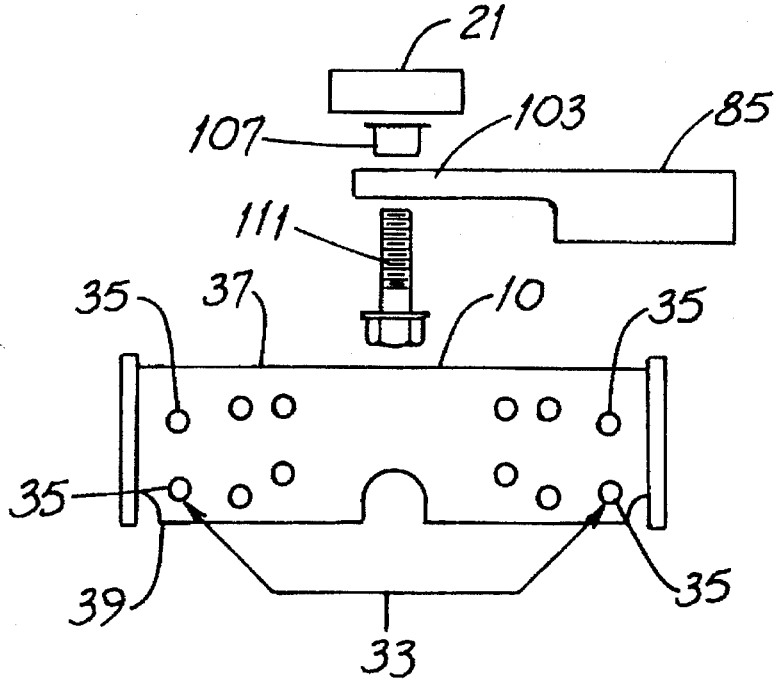
FIG. 5 is an elevation view of the new mounting bracket arranged for attachment to a Suzuki "V" engine.
Figure 6:
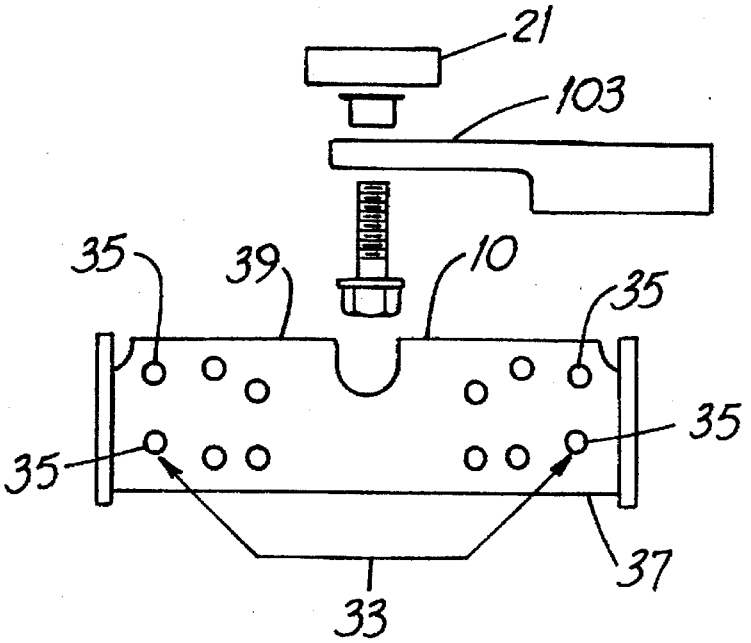
FIG. 6 is an elevation view of the new mounting bracket arranged for attachment to a Yamaha engine.

Referring next to FIGS. 3 through 7, the new bracket 10 has plural groups of holes, e.g., the group 25 comprising holes 27 (FIG. 7), the group 29 comprising holes 31 (FIG. 4) and the group 33 comprising holes 35 (FIG. 5). The holes of each group 25, 29, or 33 are sized and located to correspond with the size and location of bracket mounting holes on outboard engines manufactured by each of several different companies. The groups 25, 29 and 33 fit outboard engines made by Mercury (pre-1989), OMC and Yamaha, respectively. (It is to be noted that the orientation of the bracket 10 in FIGS. 3 and 6 and the orientation shown in FIGS. 4 and 5 are rotated 180° from one another.) This configuration imparts a degree of "universality" to the bracket in that such configuration enables a single bracket (and steering cylinder) to be used in conjunction with any of a variety of engines.

Figure 7:
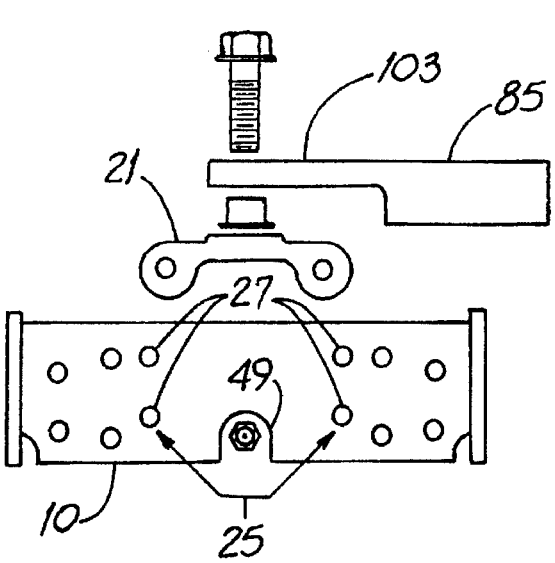
FIG. 7 is an elevation view of the new mounting bracket arranged for attachment to a Mercury engine.

FIG. 5 shows the group 33 used to attach the bracket 10 to the Suzuki "V" engine and FIG. 7 shows the group 25 used to attach the bracket 10 to other Mercury engines. The bracket 10 has first and second edges 37 and 39, respectively, and it will be noted that in FIGS. 4, 5 and 7, for example, the bracket 10 is oriented with the first edge 37 upward. In exemplary FIGS. 3 and 6, the bracket 10 is oriented with the first edge 37 downward. In the specific illustrated embodiment, both edges 37, 39, are generally linear, generally parallel to one another and generally horizontal when the bracket 10 is mounted.

Figure 8:
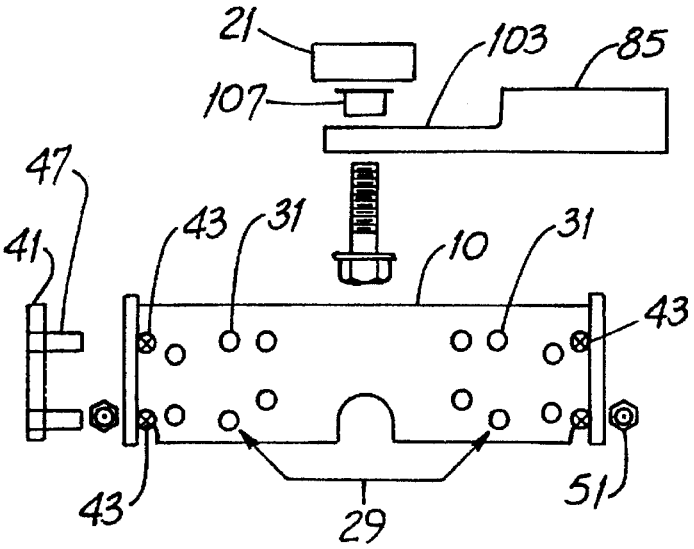
FIG. 8 is an elevation view of the new mounting bracket arranged for attachment to an OMC commercial engine and certain other OMC engines.
Figure 9:
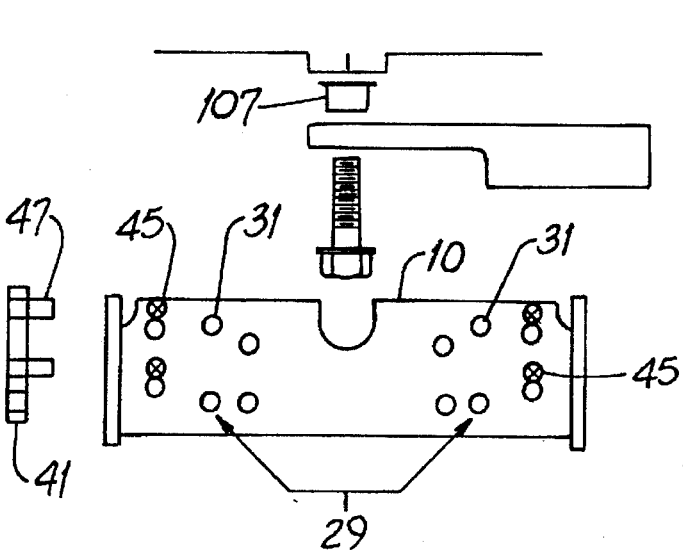
FIG. 9 is an elevation view of the new mounting bracket arranged for attachment to a Suzuki In-Line 4 engine.

FIGS. 8 and 9 illustrate special situations involving attaching the bracket 10 to relatively-rare engines, i.e., OMC Commercial/SPL and Suzuki In-Line 4, respectively. In both situations, the bracket 10 attaches to an adapter plate 41 using the holes 43 or 45 for identification. The adapter plate 41 attaches to the engine 12 using flush, tapered, flat-head bolts 47 extending through the holes 43 or 45 marked X. Group 29 and its holes 31 are used to mount the bracket 10 to the adapter plate 41.

Referring to exemplary FIGS. 4 and 7, another feature of the new bracket 10 involves at least one bracket cutout area 49 along the second edge 39 so that the bracket 10 can be fitted around a grease fitting 51 on a particular brand of engine. In a highly-preferred embodiment, the bracket 10 has two or three cutout areas 49 along such edge 39 for adapting the bracket 10 to at least two different brands of engines. For example, FIGS. 3 and 7 show how the center cutout area 49 adapts the bracket 10 to Mercury engines of different model years and FIG. 4 shows how the end cutout areas 49 adapt the bracket 10 to an OMC engine.

FIGS. 2, 10, 11 and 12 show other details of the mounting bracket 10 used to mount the cylinder 11 to the engine 12. The forces imposed on the bracket 10 by the cylinder 11 (such forces being represented by the double-ended arrow 57) are generally left/right as viewed in FIGS. 2 and 10.

A highly preferred bracket 10 has end members 59 attached to the cylinder at the mounting faces 61, 63, respectively. The members 59 and the faces 61, 63 are generally normal to the direction 57 of imposed forces and are cooperatively spaced so that when the cylinder 11 and bracket 10 are brought together, there is slight sliding clearance between the members 59 and their respective faces 61, 63. When so configured, the forces of steering are imposed across the relatively-wide areas of the members 59 and faces 61, 63. There are no (or substantially no) shear forces imposed upon the bolts 65 used to secure the bracket 10 to the cylinder 11 to one another.

Referring next to FIGS. 2, 10, 11 and 12, the steering cylinder 11 includes first and second end portions 67, 69, respectively, each having plural surfaces 71. In the specific embodiment of FIG. 10, the surfaces 71 are generally flat.

Figure 10:
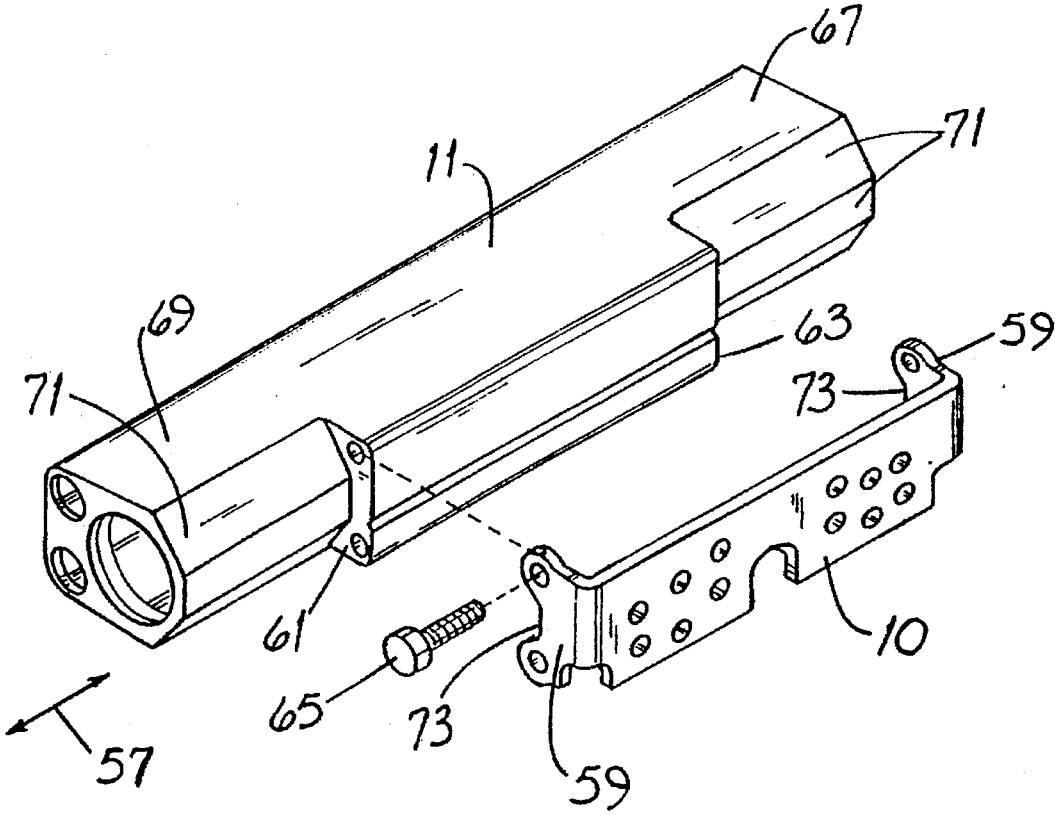
FIG. 10 is an exploded perspective view of a cylinder housing and the mounting bracket.

The bracket end members 59 each include an edge 73 contacting the respective plural surfaces 71 as shown in FIG. 10. The mounting bracket 10 thereby resists cylinder twisting about an axis coincident with or parallel to the cylinder axis 75. And any aft-of-vessel steering force components are imposed across the mating surfaces 71 and edge 73, eliminating or substantially eliminating shear forces on the bolts 65.

Figure 11:
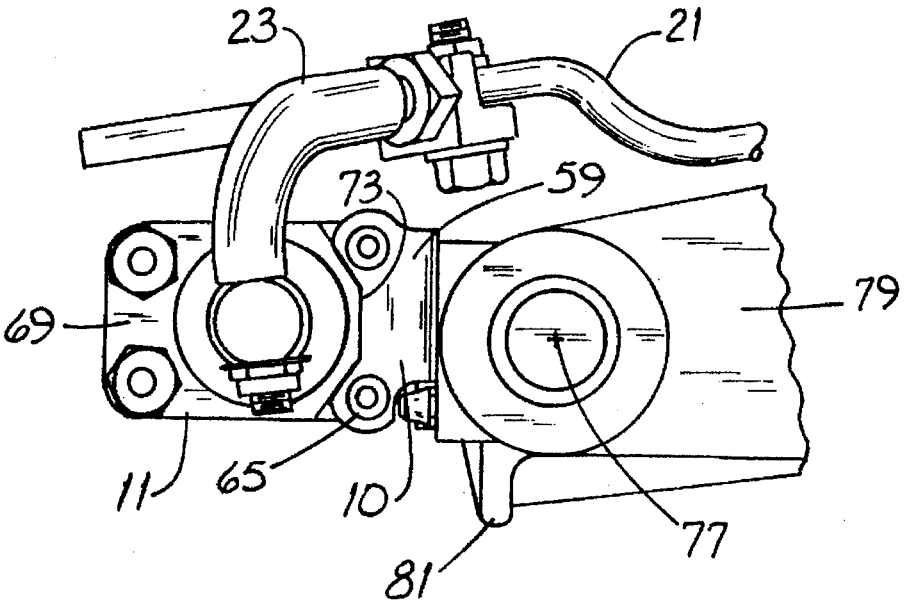
FIG. 11 is a view taken generally along the cylinder axis of FIG. 2 and showing the relative position of the cylinder to the engine stern bracket when the engine is in its normal vessel-propelling position. Parts are broken away.
Figure 12:
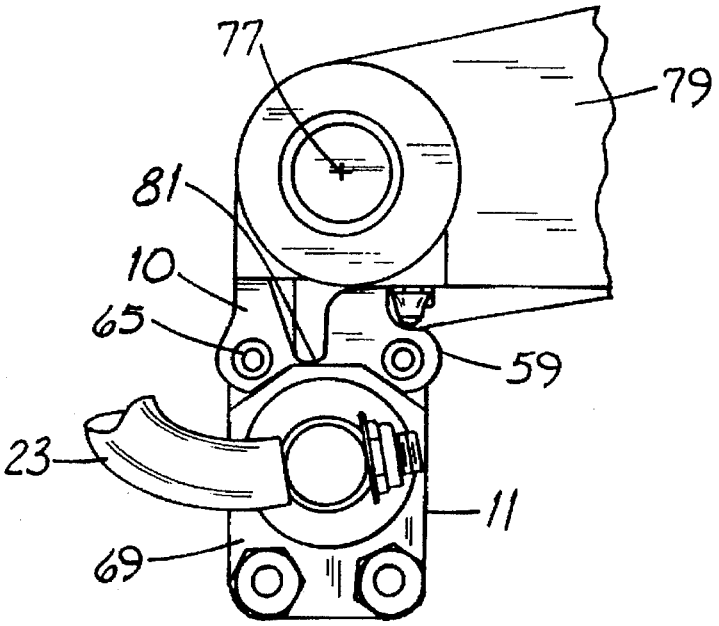
FIG. 12 is a view taken generally along the cylinder axis of FIG. 2 and showing the relative position of the cylinder to the engine stern bracket when the engine is tilted toward horizontal. Parts are broken away.

After understanding this specification and the drawings, persons working in the art will appreciate how to make cylinder end portions 67, 69 with a surface or surfaces 71 of differing shapes. Such shapes, e.g., cylindrical, elliptical or flat across the cylinder 11, are contemplated by the invention. FIGS. 11 and 12 show how the engine 12 can be pivoted about the tilt tube axis 77 and the cylinder end portions 67, 69, the bolts 65 and the bracket members 59 will nevertheless "clear" the engine stern bracket 79 and projections 81 thereof.

Referring next to FIGS. 2, 11, 12 and 13, the steering linkage 23 extends between the engine tiller bar 21 and aperture 83 at the end of the rod **19*a*. Such linkage 23 "transfers" steering force from the rod 19*a* to the engine tiller bar 21** for engine pivoting and steering.

The linkage 23 includes first and second link members 85, 87, respectively, which are preferably embodied as a clevis **85*a* and a draglink 87*a*, respectively. Such members 85, 87 are threaded to one another using fine-pitch threads 89** permitting good "vernier" adjustment of linkage length.

The first link member 85 has plural pin openings 91 while the second link member 87 has but a single pin opening 93, all openings 91, 93 being generally normal to the long axis 97 of the linkage 23. A pin 99 extends laterally between the pin opening 93 in the second link member 87 and one of the pin openings 91 in the first link member 85. After the proper linkage length and orientation of the link member 85 have been selected, the pin 99 is inserted and prevents such adjusted position from changing.

The first link member 85 includes a flat, tongue-like attachment portion 103 for coupling the first link member 85 to the tiller bar 21. The flat surfaces 105 of such attachment portion 103 are held in alignment with the flat surface of the tiller bar 21 by the pin 99.

A comparison of exemplary FIGS. 7 and 8 shows that the link member 85 is invertible and can be rotated so that the attachment portion 103 is upward as in FIG. 7 or downward as in FIG. 8. In other words, the attachment portion 103 can be offset to either side of the linkage long axis 97. This feature complements bracket universality by permitting the height of the portion surfaces 105 to be changed slightly to accommodate slightly-different tiller heights, to permit the portion 103 to be adjacent to the upper or lower surface of the tiller bar 21 or to facilitate either standard or high-speed operating modes on any of several different engines.

To couple the attachment portion 103 and the tiller bar 21 to one another, a bushing 107 is inserted into an opening 109 in the portion 103 and a screw 111 inserted through the bushing 107 and threaded to the tiller bar 21. The vertical dimension of the bushing 107 as viewed in any of the FIGS. 3 through 9 is slightly greater than the thickness of the attachment portion 103. In that way, the screw 111 can be securely tightened without preventing the attachment portion 103 from pivoting on the screw 111 as the engine 12 is steered.

Figure 13:
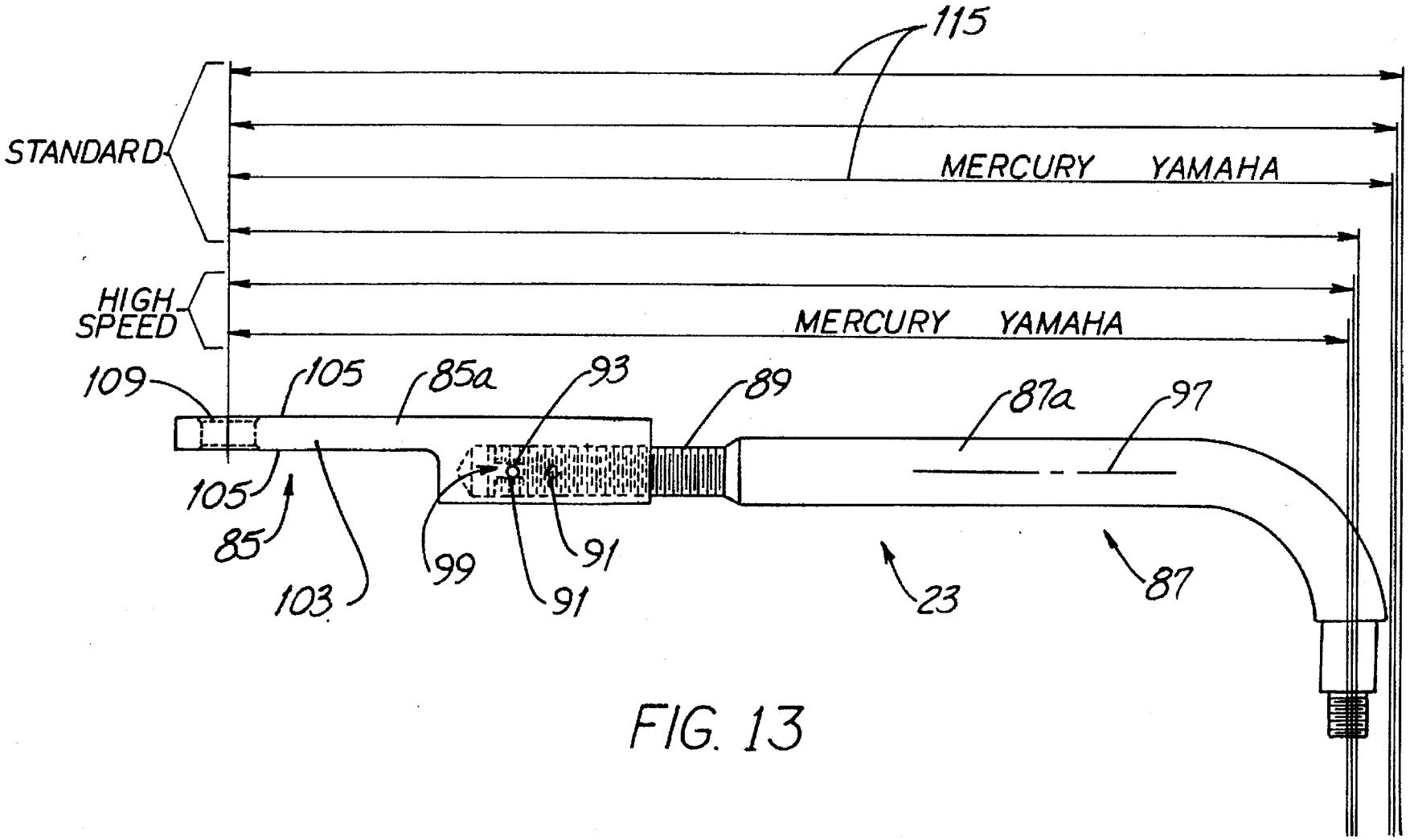
FIG. 13 is a side elevation view of steering linkage. Surfaces of parts are shown in dashed outline.

FIG. 13 has indicia (arrows 115) showing the recommended length of the linkage 23 for various brands of engines and for either standard or high-speed operation. The length indicia for Mercury and Yamaha at standard and high-speed settings are shown as examples. It will be noted that for high-speed operation, the recommended length of the linkage 23 is less than for standard operation. The reason is that a shorter linkage 23 can thereby be attached to a distal hole 117 in the tiller bar 21.

While the principles of the invention have been shown and described in connection with specific embodiments, it is to be understood clearly that such embodiments are by way of example and are not limiting.

What is claimed:

1. In combination, a boat having a boat transom and a mounting bracket coupling a hydraulic steering cylinder to a first brand of outboard engine mounted on the transom and wherein:

the steering cylinder is coupled to the first brand of engine using a first group of holes, each of which positionally corresponds to a bracket attachment hole in the first brand of engine; and the bracket includes a second group of holes, each of which positionally corresponds to a bracket attachment hole in a second brand of engine;

and wherein:

the second group of holes excludes the first group of holes;

the bracket is affixed to the first brand of engine;

the bracket and the cylinder are above the transom;

the bracket includes first and second edges;

the first edge is upward when the bracket is positioned for attachment to the first brand of engine; and the second edge is upward when the bracket is positioned for attachment to the second brand of engine.

2. The combination of claim 1 wherein each group of holes includes at least three holes.

3. The combination of claim 2 wherein each group of holes includes four holes.

4. The combination of claim 1 wherein the bracket is configured for coupling the cylinder to a third brand of engine, the bracket further including a third group of holes, each of which positionally corresponds to a bracket attachment hole in the third brand of engine.

5. The combination of claim 1 wherein the steering cylinder extends along an axis and has a steering rod exerting a steering force-and wherein:

the cylinder includes first and second spaced mounting faces angled with respect to the axis; and the bracket includes first and second end members contacting the first and second faces, respectively, whereby the first mounting face and the first end member are in compression when resisting the steering force.

6. The combination of claim 5 wherein the bracket includes at least one cutout area for fitting the bracket around a Zerk fitting on the first brand of engine.

7. The combination of claim 5 wherein the mounting faces are generally normal to the axis.

8. In the combination of (a) a steering cylinder having a housing extending along a longitudinal axis and a rod for exerting steering force, and (b) a mounting bracket for attaching the cylinder to an outboard engine having plural cylinder mounting holes arranged in a mounting hole pattern, the improvement wherein:

the bracket has plural holes corresponding in location and number to the cylinder mounting holes of the engine;

the cylinder includes first and second spaced mounting faces angled with respect to the axis; and the bracket includes first and second angled end members coextensive with the first and second angled faces, respectively; and the first mounting face and the first end member are in compression when resisting steering force.

9. The combination of claim 8 wherein the mounting faces are generally normal to the axis.

10. The combination of claim 8 wherein the bracket includes at least one cutout area for fitting the bracket around a Zerk fitting on the engine.

11. The combination of claim 8 wherein the engine is a first brand of engine:

the plural holes in the bracket comprise a first group of holes;

the bracket includes a second group of holes, each positionally corresponding to a bracket attachment hole in a second brand of engine;

the bracket has first and second edges;

the first edge is upward when the bracket is positioned for attachment to the first brand of engine; and the second edge is upward when the bracket is positioned for attachment to the second brand of engine.

12. The combination of claim 8 wherein the engine includes a tiller, the rod has an aperture, and a steering linkage extends between the aperture and the tiller, and wherein:

the linkage includes first and second link members attached to one another; and the first link member has plural pin openings, whereby the overall length of the linkage may be selected.

13. The combination of claim 12 wherein:

the first link member includes an attachment portion for coupling the first link member to the tiller;

the second link member has a pin opening;

a pin extends between the pin opening in the second link member and one of the pin openings in the first link member; and the attachment portion is held in alignment with the tiller by the pin.

14. The combination of claim 8 wherein the engine includes a tiller having an upper surface and a lower surface, the rod has an aperture, and a steering linkage extends between the aperture and the tiller, and wherein:

the linkage includes first and second link members attached to one another;

the first link member includes an offset attachment portion; and the first link member is invertible for mounting adjacent to the upper surface or the lower surface of the tiller.

15. The combination of claim 8 wherein the engine includes a tiller, the rod has an aperture, and a steering linkage extends between the aperture and the tiller, and wherein:

the linkage includes first and second link members attached to one another by threads; and the first and second link members are rotatable with respect to one another, whereby the length of the linkage may be adjusted.

16. A mounting bracket for coupling a hydraulic steering cylinder to one of first and second brands of gutboard engines and including:

a first group of holes, each of which positionally corresponds to a bracket attachment hole in the first brand of engine;

a second group of holes, each of which positionally corresponds to a bracket attachment hole in the second brand of engine; and first and second edges;

and wherein:

the first edge is upward when the bracket is positioned for attachment to the first brand of engine; and the second edge is upward when the bracket is positioned for attachment to the second brand of engine.

17. In combination, (a) a steering cylinder extending along an axis and having a steering rod for exerting a steering force, and (b) a mounting bracket for coupling the cylinder to one of first and second brands of outboard engines and wherein the bracket includes:

a first group of holes, each of which positionally corresponds to a bracket attachment hole in the first brand of engine; and a second group of holes, each of which positionally corresponds to a bracket attachment hole in the second brand of engine;

and wherein:

the cylinder includes first and second spaced mounting faces angled with respect to the axis;

the bracket includes first and second end members contacting the first and second faces, respectively; and the bracket includes at least one cutout area for fitting the bracket around a grease fitting on the first brand of engine.

18. In combination, (a) a steering cylinder extending along an axis and having a steering rod for exerting a steering force, and (b) a mounting bracket for coupling the cylinder to one of first and second brands of outboard engines and wherein the bracket includes:

a first group of holes, each of which positionally corresponds to a bracket attachment hole in the first brand of engine; and a second group of holes, each of which positionally corresponds to a bracket attachment hole in the second brand of engine;

and wherein:

the cylinder includes first and second spaced mounting faces angled with respect to the axis;

the bracket includes first and second end members contacting the first and second faces, respectively; and the steering cylinder includes a first end portion having plural surfaces; and the first end member includes an edge contacting the plural surfaces for resisting cylinder twisting.

19. In the combination of (a) a steering cylinder having a housing extending along an axis and a rod exerting steering force, and (b) a mounting bracket for attaching the cylinder to a first brand of outboard engine having plural cylinder mounting holes arranged in a mounting hole pattern, the improvement wherein:

the bracket has plural holes corresponding in location and number to the cylinder mounting holes of the engine;

the cylinder includes first and second spaced mounting faces angled with respect to the axis; and the bracket includes first and second end members contacting the first and second faces, respectively;

the plural holes in the bracket comprise a first group of holes;

the bracket includes a second group of holes, each positionally corresponding to a bracket attachment hole in a second brand of engine;

the bracket has first and second edges;

the first edge is upward when the bracket is positioned for attachment to the first brand of engine; and the second edge is upward when the bracket is positioned for attachment to the second brand of engine.

20. In combination, a boat having a boat transom and a mounting bracket coupling a hydraulic steering cylinder to a first brand of outboard engine mounted on the transom and wherein:

the steering cylinder is coupled to the first brand of engine using a first group of holes, each of which positionally corresponds to a bracket attachment hole in the first brand of engine; and the bracket includes a second group of holes, each of which positionally corresponds to a bracket attachment hole in a second brand of engine;

and wherein:

the second group of holes excludes the first group of holes;

the bracket is affixed to the first brand of engine; and the bracket and the cylinder are above the transom;

the steering cylinder extends along an axis and has a steering rod exerting a steering force and wherein:

the cylinder includes first and second spaced mounting faces angled with respect to the axis; and the bracket includes first and second end members contacting the first and second faces, respectively.

21. The combination of claim 20 wherein the bracket includes at least one cutout area for fitting the bracket around a grease fitting on the first brand of engine.

22. The combination of claim 20 wherein the mounting faces are generally normal to the axis.

* * * * *